US011485595B2

(12) United States Patent
Lin

(10) Patent No.: US 11,485,595 B2
(45) Date of Patent: Nov. 1, 2022

(54) PERIPHERAL CAPABLE OF SENSING MEDIA COUNT

(71) Applicant: AVISION INC., Hsinchu (TW)

(72) Inventor: Chia-Hsin Lin, Hsinchu (TW)

(73) Assignee: AVISION INC., Hsinchu (TW)

( * ) Notice: Subject to any disclaimer, the term of this patent is extended or adjusted under 35 U.S.C. 154(b) by 12 days.

(21) Appl. No.: 17/032,686

(22) Filed: Sep. 25, 2020

(65) Prior Publication Data

US 2021/0139261 A1 May 13, 2021

(30) Foreign Application Priority Data

Nov. 13, 2019 (TW) ..... 108141141

(51) Int. Cl.
*B65H 7/04* (2006.01)
*B65H 1/04* (2006.01)

(52) U.S. Cl.
CPC ..... *B65H 7/04* (2013.01); *B65H 1/04* (2013.01); *B65H 2511/515* (2013.01); *B65H 2801/06* (2013.01)

(58) Field of Classification Search
CPC ..... B65H 7/04
USPC ..... 101/233
See application file for complete search history.

(56) References Cited

U.S. PATENT DOCUMENTS 5,692,231 A * 11/1997 O ..... B41J 13/103 399/23
5,897,112 A * 4/1999 Kwag ..... B65H 1/266 271/38
7,668,501 B2 * 2/2010 Murakami ..... B41J 29/023 399/392
2017/0368843 A1 * 12/2017 Yuasa ..... B65H 1/04
2018/0282084 A1 * 10/2018 Inoue ..... B65H 7/04

FOREIGN PATENT DOCUMENTS

JP 2019-142678 * 8/2019 ..... B65H 1/26

* cited by examiner

*Primary Examiner* — Matthew G Marini
*Assistant Examiner* — Marissa Ferguson-Samreth
(74) *Attorney, Agent, or Firm* — Muncy, Geissler, Olds & Lowe, P.C.

(57) ABSTRACT

A peripheral capable of sensing a media count includes a body, a stopper, a supply tray and a sensor assembly. The stopper is installed in the body. The supply tray accommodated within the body includes a base and a frame. The frame elastically and pivotally connected to the base supports media and pushes the media in a direction toward the stopper so that the media contacts the stopper. The sensor assembly installed in the body detects a position state of the frame to obtain a sensing signal corresponding to the number of the media.

12 Claims, 5 Drawing Sheets

PERIPHERAL CAPABLE OF SENSING MEDIA COUNT

CROSS-REFERENCE TO RELATED APPLICATIONS

This application claims priority of No. 108141141 filed in Taiwan R.O.C. on Nov. 13, 2019 under 35 USC 119, the entire content of which is hereby incorporated by reference.

BACKGROUND OF THE INVENTION

Field of the Invention

This disclosure relates to a peripheral capable of sensing a media count, and more particularly to a peripheral capable of sensing the number of media instead of sensing presence or absence of a medium.

Description of the Related Art

A conventional printer, such as a laser printer, an ink-jet printer or the like prints data onto a sheet. When there is no sheet to be printed, the printer outputs a sheet-absence message to notify the user to replenish the sheets so that the printing process can be performed again. Such the sensing method adopts a micro switch disposed on a tray so that the sheet presses the micro switch and a sheet-presence state is determined. When the sheets are used up, there is no sheet pressing the micro switch, so that a sheet-absence state is determined.

The above-mentioned sensing method only can sense the presence or absence of the sheets, and cannot sense the number of sheets to determine the high number of sheets, the medium number of sheets and the low number of sheets, so that the user can have different responses accordingly.

Although a sensor can be used to sense the height of the stack of sheets and thus to determine the number of sheets, such the design needs the complicated layout. Because the number of sheets gradually decreases, a complicated pick-up mechanism is required to satisfy the function of picking up the sheet from different numbers of sheets stacked together. For example, a pick-up roller for downwardly picking up the sheet or an active intermittent lift-up mechanism for lifting up the sheet intermittently can be provided and needs a motor and the control logic to intermittently push the sheet toward the pick-up roller, so that the printer has the more complicated design and the increased cost.

BRIEF SUMMARY OF THE INVENTION

It is therefore an objective of this disclosure to provide a peripheral for sensing a position state of a frame of a supply tray to achieve a function of sensing a media count in the peripheral having a permanent media lift-up mechanism.

To achieve the above-identified object, this disclosure provides a peripheral capable of sensing a media count. The peripheral includes a body, a stopper, a supply tray and a sensor assembly. The stopper is installed in the body. The supply tray accommodated within the body includes a base and a frame. The frame elastically and pivotally connected to the base supports media and pushes the media in a direction toward the stopper so that the media contacts the stopper. The sensor assembly installed in the body detects a position state of the frame to obtain a sensing signal corresponding to the number of the media.

With the above-mentioned embodiment, the peripheral can achieve the function of sensing the media count by sensing the position state of the frame of the supply tray of the peripheral, wherein a contact-type rocker arm in contact with the frame or a contactless sensor not in contact with the frame is adopted, so that the function of sensing the media count in the peripheral having the permanent media lift-up mechanism can be provided to have the advantages of the simple structure and the low cost.

Further scope of the applicability of this disclosure will become apparent from the detailed description given hereinafter. However, it should be understood that the detailed description and specific examples, while indicating preferred embodiments of this disclosure, are given by way of illustration only, since various changes and modifications within the spirit and scope of this disclosure will become apparent to those skilled in the art from this detailed description.

DETAILED DESCRIPTION OF THE INVENTION

The embodiment of this disclosure provides a peripheral capable of sensing the approximate or exact media count (e.g., 5, 10, 20 or 40) rather than sensing the presence or absence of the media.

Figure 1:
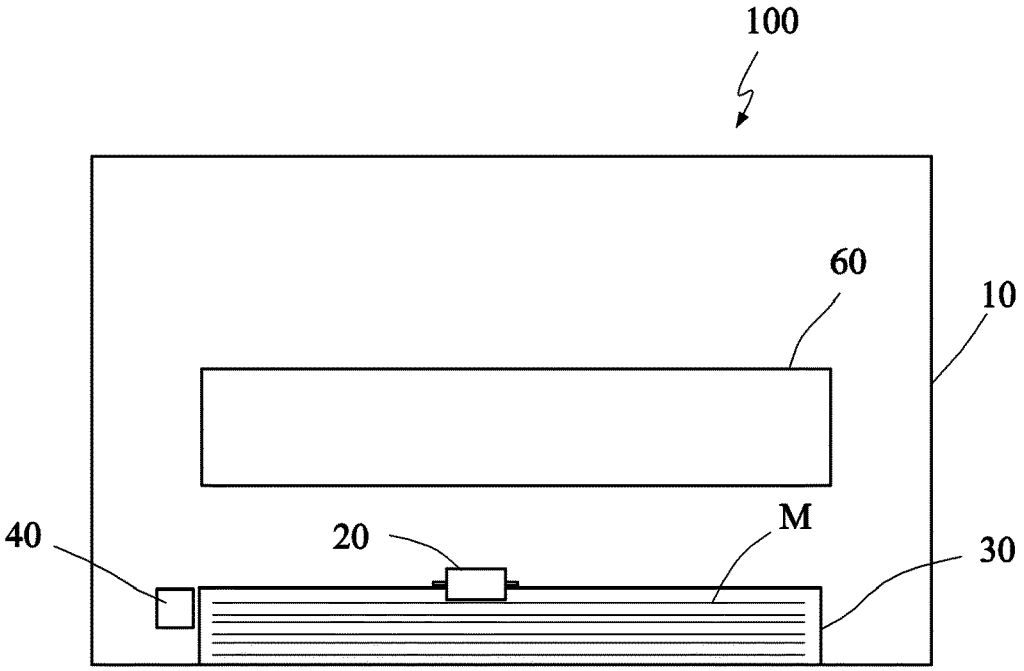
FIG. 1 is a schematic view showing a peripheral according to a preferred embodiment of this disclosure.
Figure 2:
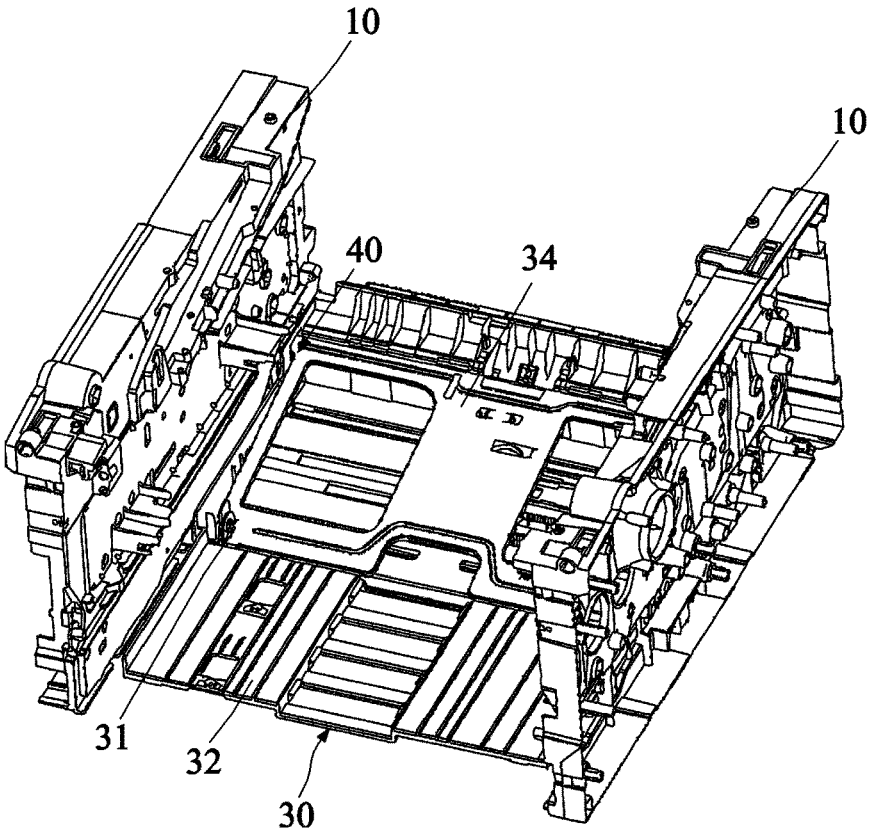
FIG. 2 is a partially pictorial view showing the peripheral according to the preferred embodiment of this disclosure.

FIG. 1 is a schematic view showing a peripheral 100 according to the preferred embodiment of this disclosure. FIG. 2 is a partially pictorial view showing the peripheral 100 according to the preferred embodiment of this disclosure. Referring to FIGS. 1 and 2, the peripheral 100 of this disclosure capable of sensing the media count includes a body 10, a stopper 20, a supply tray 30 and a sensor assembly 40.

Figure 9:
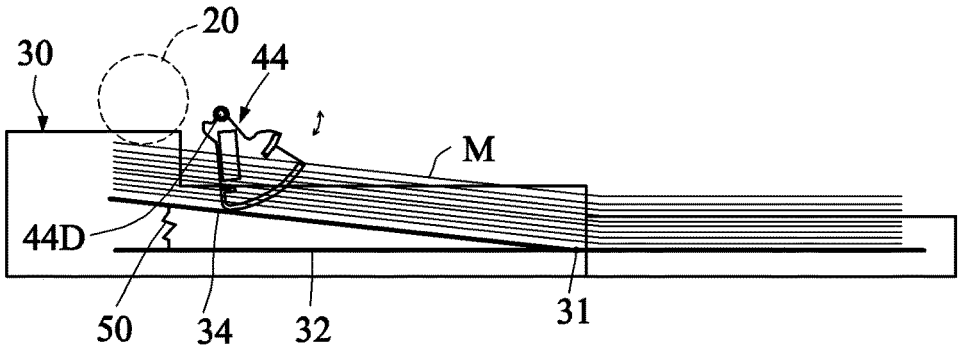
FIGS. 9 and 10 show two states of the peripheral of FIG. 6 upon executing the function of sensing the media count.
Figure 10:
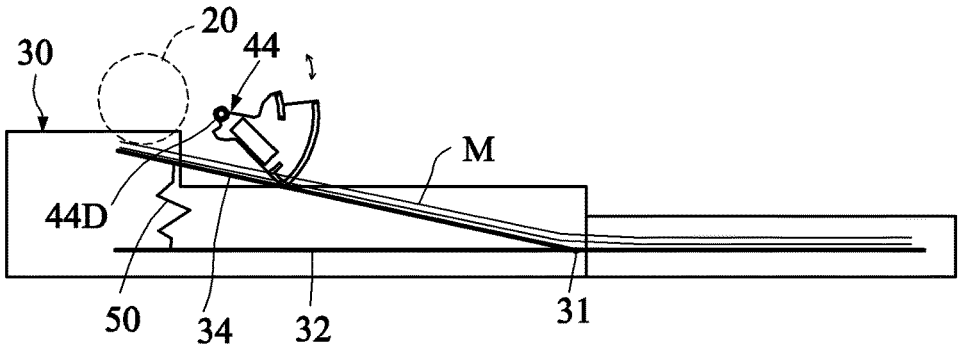

The stopper 20 is installed in the body 10. The supply tray 30 accommodated within the body 10 includes a base 32 and a frame 34. The frame 34 elastically and pivotally connected to the base 32 (e.g., pivotally connected to a pivotal connection portion 31, see also FIG. 6), carries and supports the media M and pushes the media M in a direction toward the stopper 20 so that the media M directly contacts the stopper 20. The media M may be, for example, sheets, photos, slides or the like. For example, as shown in FIGS. 9 and 10, the peripheral 100 may further include an elastic member 50 connected to the base 32 and the frame 34 to push the media M on the frame 34 in the direction toward the stopper 20. The elastic member 50 may be a compression spring, a tension spring or a torsion spring.

The sensor assembly 40 installed in the body 10 senses a position state of the frame 34 (e.g., the vertical position of one portion of the frame 34, or the included angle between the frame 34 and the base 32) to obtain a sensing signal corresponding to the number of the media M. When the included angle is sensed, an angular sensor serves as the sensor assembly to sense the rotation angle of the pivot of the frame 34 or the base 32.

In this embodiment, the stopper 20 is a roller, and the roller contacts the media M to transport one of the media M directly contacting the roller. In addition, the peripheral 100 is a printer, and thus further includes a printing module 60 for printing data onto the medium M transported by the roller. In other embodiments, however, the peripheral 100 may also be a scanner, a copier, a fax machine or the like.

Figure 3:
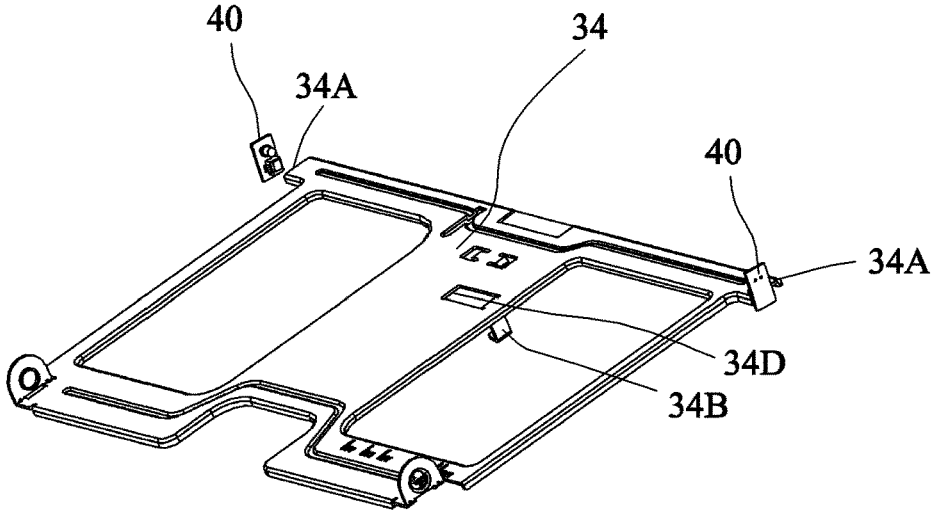
FIG. 3 is a pictorial view showing an example capable of executing the function of sensing a media count.
Figure 4A:
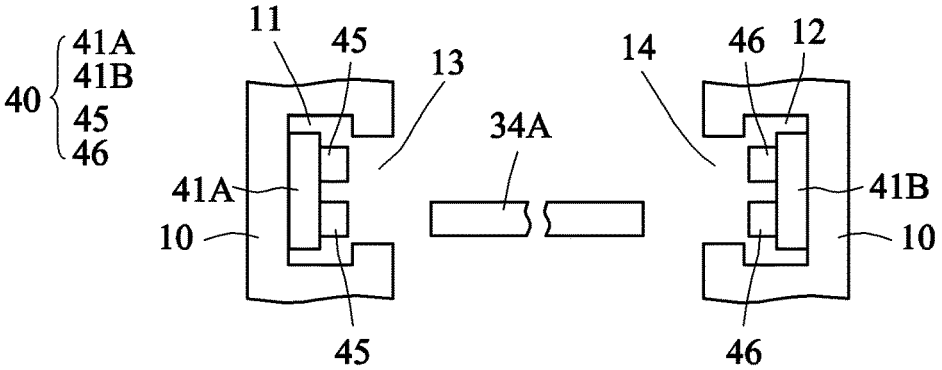
FIGS. 4A, 4B, 5A and 5B are schematic views showing examples of FIG. 3.
Figure 4B:
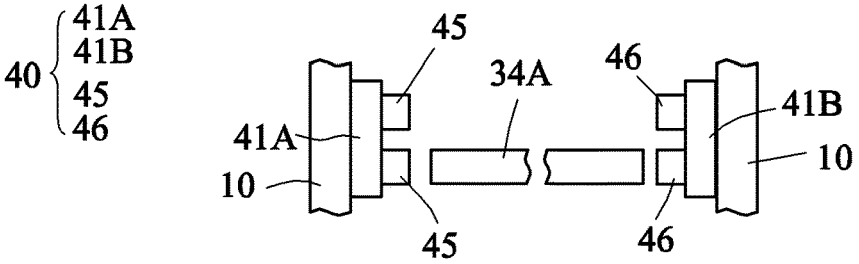

FIG. 3 is a pictorial view showing an example capable of executing the function of sensing the media count. FIGS. 4A, 4B, 5A and 5B are schematic views showing examples of FIG. 3. Referring to FIGS. 3 and 4A, the sensor assembly 40 includes a first circuit board 41A, a second circuit board 41B, transmitters 45 and receivers 46. The first circuit board 41A and the second circuit board 41B face each other and are mounted on the body 10. For example, the first circuit board 41A and the second circuit board 41B are respectively disposed in a first accommodating slot 11 and a second accommodating slot 12 of the body 10. That is, the sensor assembly 40 is installed in the first accommodating slot 11 and the second accommodating slot 12. The first accommodating slot 11 accommodates the first circuit board 41A and the transmitters 45 and further provides a first sheet passage 13 through which the signals pass. The second accommodating slot 12 accommodates the second circuit board 41B and the receivers 46, and further provides a second sheet passage 14 through which the signals pass. The accommodating slots are provided to protect the circuit boards, the transmitters and the receivers. Meanwhile, the positioning function of facilitating the installation without manually aligning the transmitters with the receivers can be provided. The frame 34 has a free end portion 34A movable between the first circuit board 41A and the second circuit board 41B. The frame 34 also has a stand 34B, which is formed by stamping a portion of the frame 34 to form an opening 34D corresponding to the stand 34B, and can be used to restrict a rotation angle between the frame 34 and the base 32 when the stand 34B touches the bottom of the base 32 (see FIG. 2). The stand 34B has a hook-like structure to increase its structural strength. The free end portion 34A is movable in a guiding slot 15 of the body 10 (see FIG. 6) and is also restricted by the guiding slot 15. For example, the topmost and bottommost positions of the free end portion 34A may be restricted by the top and bottom edges of the guiding slot 15. The transmitters 45 are mounted on the first circuit board 41A. The receivers 46 mounted on the second circuit board 41B face the transmitters 45. The free end portion 34A of the frame 34 (or inclusive of the media M) makes the receivers 46 receive or not receive the corresponding emitting signals to generate the sensing signal by blocking or not blocking emitting signals of the transmitters 45. When only a predetermined number (e.g., 30 to 50) of sheets are left, the free end portion of the frame is lifted up to the position above the transmitter/receiver. At this time, the transmitter is not blocked, so the receiver can receive the emitting signal. It is worth noting that one single receiver 46 and one single transmitter 45 may also achieve the function of this embodiment. FIG. 4B is similar to FIG. 4A except for the difference that the first circuit board 41A and the second circuit board 41B facing each other are mounted on the body 10, but are not disposed in the accommodating slots.

Figure 5A:
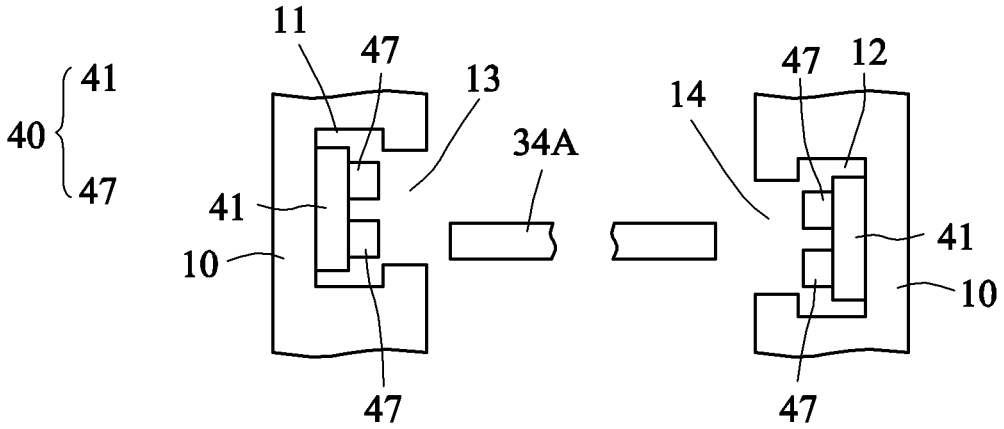
Figure 5B:
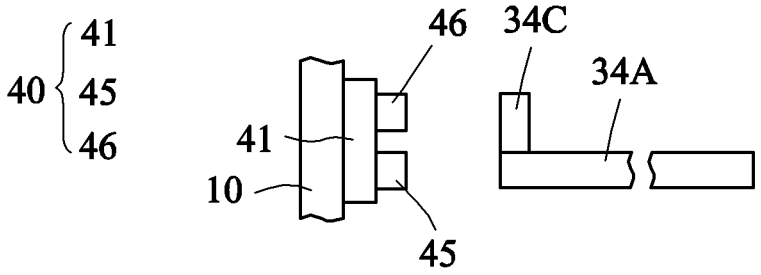

Referring to FIGS. 3 and 5A, the sensor assembly 40 includes a circuit board 41 and transceivers 47. The circuit board 41 is mounted on the body 10 in a manner similar to that of FIG. 4A. The transceivers 47 mounted on the circuit board 41 detect a position of the free end portion 34A of the frame 34 to generate the sensing signal. Thus, the transceivers 47 disposed on one side of the free end portion 34A can achieve the function of sensing the media count. In addition, one single transceiver 47 may also be disposed on the same circuit board 41. In addition, multiple transceivers disposed on two sides of the free end portion 34A may also be staggered in the vertical direction, so that four levels of the free end portion 34A can be sensed and the information of four media counts can be obtained. Referring to FIG. 5B, the sensor assembly 40 includes a circuit board 41, a transmitter 45 and a receiver 46. Both of the transmitter 45 and the receiver 46 are mounted on the circuit board 41, and can be integrated into one transceiver. A vertical stopper plate 34C, which reflects the emitting signal outputted from the transmitter 45 of the sensor assembly 40, is mounted on the free end portion 34A so that the receiver 46 of the sensor assembly 40 receives the emitting signal to achieve the function of sensing the media count. The vertical stopper plate may also be used to fix the positions of the media M so that the media M can be aligned. It is worth noting that the sensor assembly 40 may also be installed in one accommodating slot 11 in a manner similar to that of FIG. 5A.

Figure 6:
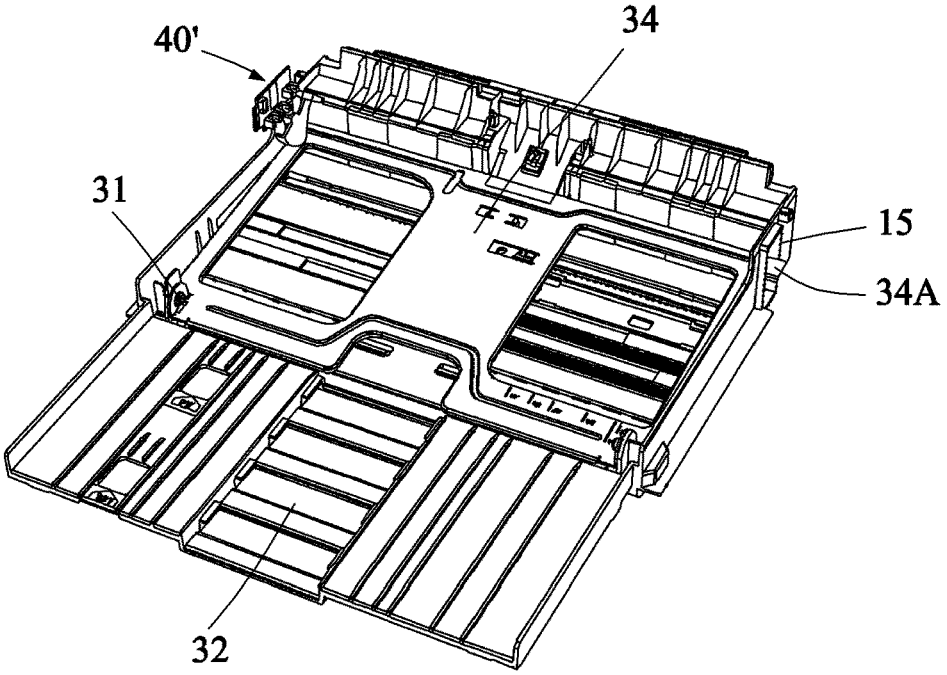
FIGS. 6 and 7 are partially pictorial views showing another example of the peripheral according to the preferred embodiment of this disclosure.
Figure 7:
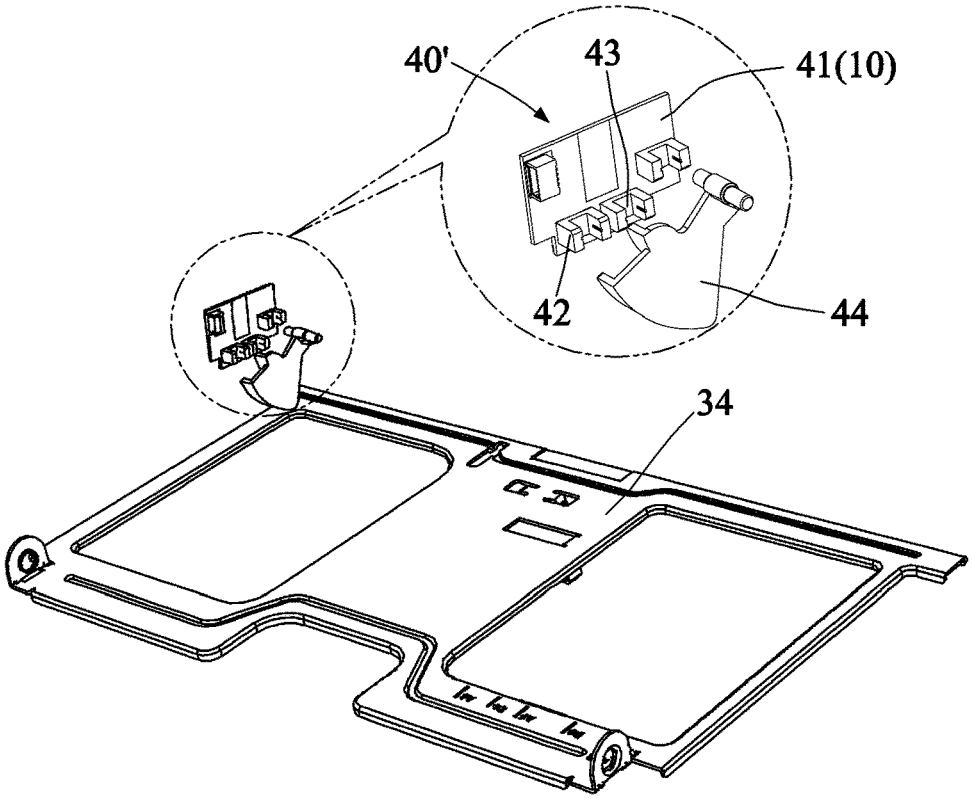
Figure 8:
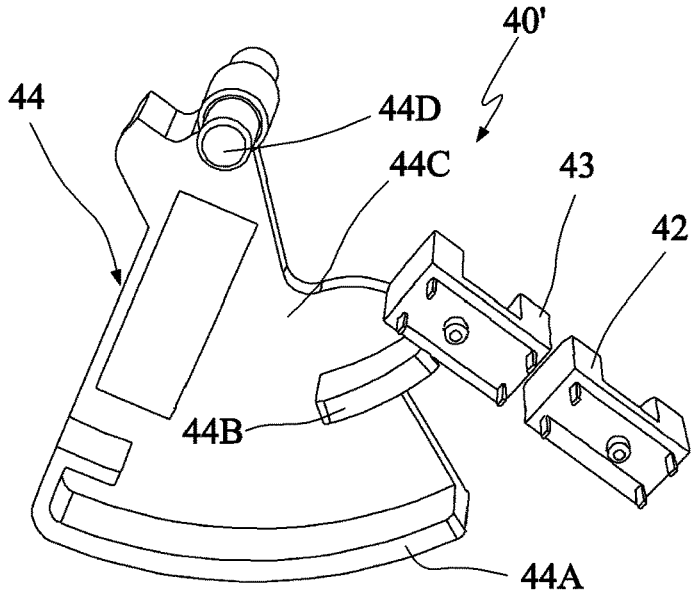
FIG. 8 is an enlarged view showing the sensor assembly of FIG. 6.

FIGS. 6 and 7 are partially pictorial views showing another example of the peripheral according to the preferred embodiment of this disclosure. FIG. 8 is an enlarged view showing the sensor assembly of FIG. 6. Referring to FIGS. 8, 6 and 7, the sensor assembly 40' includes a circuit board 41, sensors 42 and 43 and a rocker arm 44. The circuit board 41 is mounted on the body 10. The sensors 42 and 43 are mounted on the circuit board 41. The rocker arm 44 rotatably mounted on the body 10 directly contacts the frame 34. For example, the rocker arm 44 contacts the free end portion 34A, so that the frame 34 directly exerts a thrust onto the rocker arm 44. The rocker arm 44 does not directly contact the media M upon detecting the position state of the frame 34. The rocker arm 44 includes trigger structures 44A and 44B correspondingly triggering one or both of the sensors 42 and 43 to generate the sensing signal. It is worth noting that the effect of this embodiment can also be achieved when only one sensor and only one trigger structure are provided. In addition, the rocker arm 44 may further include a base part 44C and a pivot 44D. The base part 44C has a fan-shaped structure. The pivot 44D connected to one end of the base part 44C is rotatably mounted on the body 10. In this embodiment, the trigger structures 44A and 44B are present as arced stopper walls uprightly disposed on the base part 44C. A central axis of each arced stopper wall is disposed on the pivot 44D. The rocker arm 44 may be integrally formed by way of plastic injection molding. The sensors 42 and 43 are transceivers capable of transmitting and receiving signals. In this embodiment, the trigger structures 44A and 44B have different arced lengths to provide sensing of different ranges of media counts. Each sensor has a state blocked by the trigger structure, and another state not blocked by the trigger structure, so that four states corresponding to different four media counts can be obtained according to the combinations.

In one example, when the trigger structures 44B and 44A do not respectively block the sensors 43 and 42, a first state corresponding the high media count (e.g., 50) is present.

When the trigger structure 44B blocks the sensor 43 and the trigger structure 44A does not block the sensor 42, a second state corresponding to the moderate media count (e.g., 20) is present. When the trigger structure 44B blocks the sensor 43 and the trigger structure 44A also blocks the sensor 42, a third state corresponding to the low media count (e.g., 5) is present. According to the above-mentioned explanation, the function of sensing the media count can be achieved so that the user can respond in advance according to the result. For example, in the case when the user needs to print data on 20 media but there are only 5 media left, the user can replace the left media with a new batch of media to prevent the problem of the inconsistent printed results having the color differences or the like.

It is worth noting that the circuit board 41 is optional, so the sensors 42 and 43 may also be mounted on the body 10.

FIGS. 9 and 10 show two states of the peripheral of FIG. 6 upon executing the function of sensing the media count. Referring to FIGS. 9 and 10, because the bottom portion of the supply tray 30 has a permanent lift-up mechanism (but not the intermittent lift-up mechanism driven by the motor), the stopper 20 is always kept in contact with the media M. Thus, the number of the media cannot be sensed by sensing the height position of the topmost medium M. In this embodiment, the rocker arm 44 directly contacts the frame 34 but does not directly contact the media M. The function of detecting the media count can be achieved by detecting the height or level of the predetermined position of the frame 34 (equivalent to the angle between the frame 34 and the base 32). The media count in FIG. 9 is greater than that in FIG. 10, but the frame 34 in both of FIGS. 9 and 10 can push the topmost medium M against the stopper 20 so that the medium M can be smoothly transported into the printing sheet passage.

With the above-mentioned embodiment, the peripheral can achieve the function of sensing the media count by sensing the position state of the frame of the supply tray of the peripheral, wherein a contact-type rocker arm in contact with the frame or a contactless sensor not in contact with the frame is adopted, so that the function of sensing the media count in the peripheral having the permanent media lift-up mechanism can be provided to have the advantages of the simple structure and the low cost.

While this disclosure has been described by way of examples and in terms of preferred embodiments, it is to be understood that this disclosure is not limited thereto. To the contrary, it is intended to cover various modifications. Therefore, the scope of the appended claims should be accorded the broadest interpretation so as to encompass all such modifications.

What is claimed is:

1. A peripheral capable of sensing a media count, the peripheral comprising:

a body;

a stopper installed in the body;

a supply tray accommodated within the body, wherein the supply tray comprises a base and a frame, and the frame elastically and pivotally connected to the base supports media and presses the media in a direction toward the stopper so that the media contact the stopper; and a sensor assembly, which is installed in the body and detects a position state of the frame to obtain a sensing signal corresponding to a quantity of the media, wherein the sensor assembly directly and permanently contacts the frame, which is permanently lifted up by an elastic member connected to the base and the frame to push the media on the frame in the direction toward the stopper without being intermittently lifted up by an intermittent lift-up mechanism, to detect the position state of the frame without directly contacting the media.

2. The peripheral according to claim 1, wherein the sensor assembly comprises:

a circuit board mounted on the body;

one or multiple sensors mounted on the circuit board; and a rocker arm, which is rotatably mounted on the body, contacts the frame, and comprises one or multiple trigger structures correspondingly triggering the one or multiple sensors to generate the sensing signal.

3. The peripheral according to claim 2, wherein the rocker arm further comprises:

a base part; and a pivot, which is connected to one end of the base part and rotatably mounted on the body, wherein:

the one or multiple trigger structures are one or multiple arced stopper walls uprightly disposed on the base part, and a central axis of the arced stopper wall or each of the arced stopper walls is disposed on the pivot.

4. The peripheral according to claim 1, wherein the sensor assembly comprises:

one or multiple sensors mounted on the body; and a rocker arm, which is rotatably mounted on the body, contacts the frame, and comprises one or multiple trigger structures correspondingly triggering the one or multiple sensors to generate the sensing signal.

5. The peripheral according to claim 1, wherein the sensor assembly comprises:

a circuit board mounted on the body; and one or multiple transceivers, which are mounted on the circuit board and detect a position of a free end portion of the frame to generate the sensing signal.

6. The peripheral according to claim 1, wherein the stopper is a roller, and the roller contacts the media to transport one of the media in direct contact with the roller.

7. The peripheral according to claim 1, wherein the sensor assembly is installed in one or multiple accommodating slots of the body.

8. The peripheral according to claim 1, wherein a vertical stopper plate is mounted on a free end portion of the frame, and the vertical stopper plate reflects an emitting signal of the sensor assembly to the sensor assembly receiving the emitting signal.

9. The peripheral according to claim 1, wherein the frame has a stand corresponding to an opening of the frame, and the stand restricts a rotation angle between the frame and the base.

10. The peripheral according to claim 1, wherein a free end portion of the frame is movable in and restricted by a guiding slot of the body.

11. A peripheral capable of sensing a media count, the peripheral comprising:

a body;

a stopper installed in the body;

a supply tray accommodated within the body, wherein the supply tray comprises a base and a frame, and the frame elastically and pivotally connected to the base supports media and presses the media in a direction toward the stopper so that the media contact the stopper; and a sensor assembly, which is installed in the body and detects a position state of the frame to obtain a sensing signal corresponding to a quantity of the media, wherein the sensor assembly directly contacts the frame without directly contacting the media upon detecting the position state of the frame, wherein the sensor assembly comprises:

one or multiple sensors mounted on the body; and a rocker arm, which is rotatably mounted on the body, contacts the frame, and comprises:

one or multiple trigger structures correspondingly triggering the one or multiple sensors to generate the sensing signal;

a base part; and a pivot, which is connected to one end of the base part and rotatably mounted on the body, wherein:

the one or multiple trigger structures are one or multiple arced stopper walls uprightly disposed on the base part, and a central axis of the arced stopper wall or each of the arced stopper walls is disposed on the pivot.

12. A peripheral capable of sensing a media count, the peripheral comprising:

a body;

a stopper installed in the body;

a supply tray accommodated within the body, wherein the supply tray comprises a base and a frame, and the frame elastically and pivotally connected to the base supports media and presses the media in a direction toward the stopper so that the media contact the stopper; and a sensor assembly, which is installed in the body and detects a position state of the frame to obtain a sensing signal corresponding to a quantity of the media, wherein the sensor assembly directly contacts the frame without directly contacting the media upon detecting the position state of the frame, wherein the sensor assembly comprises:

a first circuit board and a second circuit board facing each other and being mounted on the body, wherein a free end portion of the frame is movable between the first circuit board and the second circuit board;

one or multiple transmitters mounted on the first circuit board; and one or multiple receivers, which are mounted on the second circuit board and face the one or multiple transmitters, wherein the free end portion of the frame blocks or does not block one or multiple emitting signals of the one or multiple transmitters to make the one or multiple receivers receive or not receive the corresponding one or multiple emitting signals, so that the sensing signal is generated.

* * * * *